US008462971B2

(12) United States Patent
Gommel et al.

(10) Patent No.: US 8,462,971 B2
(45) Date of Patent: Jun. 11, 2013

(54) EAR MOLD WITH ADAPTER SEAL

(75) Inventors: Uli Gommel, Erlangen (DE); Hartmut Ritter, Neunkirchen am Brand (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1028 days.

(21) Appl. No.: 12/152,575

(22) Filed: May 15, 2008

(65) Prior Publication Data

US 2008/0285782 A1 Nov. 20, 2008

(30) Foreign Application Priority Data

May 16, 2007 (DE) ..... 10 2007 023 054

(51) Int. Cl.
*H04R 25/00* (2006.01)

(52) U.S. Cl.
USPC ..... 381/322

(58) Field of Classification Search
USPC ..... 381/322, 325, 328, 330
See application file for complete search history.

(56) References Cited

U.S. PATENT DOCUMENTS

| | | | | |
|---|---|---|---|---|
| 3,813,499 | A | 5/1974 | Vignini | |
| 4,739,512 | A * | 4/1988 | Hartl et al. | 381/328 |
| 4,977,976 | A | 12/1990 | Major | |
| 5,701,348 | A * | 12/1997 | Shennib et al. | 381/328 |
| 5,742,692 | A * | 4/1998 | Garcia et al. | 381/328 |
| 6,129,174 | A * | 10/2000 | Brown et al. | 181/135 |
| 6,860,362 | B2 * | 3/2005 | Saltykov | 181/135 |
| 7,110,562 | B1 | 9/2006 | Feeley et al. | |
| 7,401,679 | B2 * | 7/2008 | Ipsen | 181/129 |
| 2002/0006209 | A1 | 1/2002 | Mahoney et al. | |
| 2007/0009130 | A1 | 1/2007 | Feeley et al. | |
| 2009/0296969 | A1 | 12/2009 | Feeley et al. | |

FOREIGN PATENT DOCUMENTS

| | | | |
|---|---|---|---|
| DE | 86 11 816 | U1 | 7/1986 |
| WO | WO 9736457 | | 10/1997 |
| WO | 9907182 | A2 | 2/1999 |
| WO | WO 2004/025990 | A1 | 3/2004 |
| WO | WO 2005055655 | | 6/2005 |

* cited by examiner

*Primary Examiner* — Steven Loke
*Assistant Examiner* — Kimberly M Thomas

(57) ABSTRACT

When external receivers are used in hearing devices there is a need to suppress feedback further. An ear mold with a receiver is therefore proposed, having a receiver connector including a first snap-fit element at the sound outlet. An adapter is inserted directly into the ear mold and has a second snap-fit element, which is snapped into the first snap-fit element in a manner such that it can be released. A seal, which surrounds the receiver connector completely, is made of a more elastic material than the receiver connector and the adapter and is fitted between the receiver connector and the adapter. It is thus possible to secure the receiver in the ear mold in an acoustically sealed manner, so that there is less feedback. The seal however also ensures that less dirt reaches the receiver.

20 Claims, 3 Drawing Sheets

EAR MOLD WITH ADAPTER SEAL

CROSS REFERENCE TO RELATED APPLICATIONS

This application claims priority of German application No. 10 2007 023 054.2 DE filed May 16, 2007, which is incorporated by reference herein in its entirety.

FIELD OF INVENTION

The present invention relates to an ear mold for a hearing device with a receiver, having a receiver connector including a first snap-fit element at the sound outlet, and an adapter, which is inserted directly into the ear mold and which has a second snap-fit element, which is snapped into the first snap-fit element in a manner such that it can be released. A hearing device here refers in particular to a device that can be worn on the ear, such as a hearing aid, a headset, headphones, etc.

BACKGROUND OF INVENTION

Hearing aids are wearable hearing devices, which serve to assist the hearing impaired. To satisfy the numerous individual requirements, different models of hearing aids are available, such as behind-the-ear hearing aids (BTE) and in-the-ear hearing aids (ITE) as well as concha hearing aids and completely-in-the-canal hearing aids (CIC) for example. The hearing aids listed by way of example are worn on the outer ear or in the auditory canal. Also available on the market are bone conduction hearing aids and implantable or vibrotactile hearing aids. Here the damaged hearing is stimulated either mechanically or electrically.

The essential components of hearing aids are in principle an input converter, an amplifier and an output converter. The input converter is generally a sound receiver, e.g. a microphone, and/or an electromagnetic receiver, e.g. an induction coil. The output converter is generally in the form of an electro-acoustic converter, e.g. a miniature loudspeaker, or an electromechanical converter, e.g. a bone conduction receiver. The amplifier is generally integrated in a signal processing unit. This basic structure is shown in FIG. 1 using the example of a behind-the-ear hearing aid. One or more microphones 2 for picking up the sound from the surroundings are built into a hearing aid housing 1 to be worn behind the ear. A signal processing unit 3, which is likewise integrated in the hearing aid housing 1, processes the microphone signals and amplifies them. The output signal of the signal processing unit 3 is transmitted to a loudspeaker or receiver 4, which outputs an acoustic signal. In some instances the sound is transmitted by way of a sound tube, which is fixed in the auditory canal with an otoplastic, to the eardrum of the aid wearer. Power is supplied to the hearing aid and in particular to the signal processing unit 3 by way of a battery 5, which is likewise integrated in the hearing aid housing 1.

BTE hearing aids are frequently provided with an external receiver unit. This external receiver unit is inserted into the ear canal and receives its electrical signals from a hearing aid main unit worn behind the auricle.

The external receiver unit generally consists of an ear mold, in which a loudspeaker or receiver is secured. The receiver is snap-fitted in the ear mold for example. To this end the receiver has a receiver connector, which forms a snap-fit connection with the ear mold. Both components of the snap-fit connection are typically made of polyamide.

SUMMARY OF INVENTION

The problem with such receiver units is that with higher amplifications, for example over 40 dB, the output sound is frequently fed back, so that the hearing aid wearer experiences an unpleasant whistling. Such feedback also occurs in particular with wear, when receivers are replaced repeatedly in the mold.

The publication WO 2004/025990 A1 discloses a hearing aid with an external receiver. The external receiver consists of a loudspeaker, which can be inserted into a soft earpiece with the aid of an adapter. The loudspeaker housing has a lug, which enables it to latch into the adapter. The material of the earpiece is softer than that of the adapter.

The adapter material is in turn softer than that of the loudspeaker housing.

The publication DE 86 11 816 U1 also describes an adapter device for hearing aids to be worn in the ear canal. An ear olive made of an elastic plastic is intended to be snap-fitted onto an adapter. A sound outlet connector of the hearing aid is snapped into a cone of the adapter. The adapter consists of a fairly elastic plastic.

The publication U.S. Pat. No. 4,977,976 also discloses a connecting piece connecting a sound tube to an earpiece. A plug seals the connecting element off from the earpiece.

The object of the present invention is therefore to prevent feedback with external receiver units of hearing devices as far as possible.

According to the invention this object is achieved by an ear mold for a hearing device with a receiver, having a receiver connector including a first snap-fit element at the sound outlet, and an adapter, which is inserted directly into the ear mold and which has a second snap-fit element, which is snapped into the first snap-fit element in a manner such that it can be released, and a seal, which surrounds the receiver connector completely, is made of a more elastic material than the receiver connector and the adapter and is fitted between the receiver connector and the adapter.

The seals advantageously compensate for manufacturing tolerances of the adapter and the receiver connector, so that sound can no longer penetrate through between the adapter and the receiver connector outward. It is thus possible to prevent feedback effectively even for high amplifications.

The adapter is preferably made of polyamide or a similarly hard plastic. The same applies to the receiver connector. In contrast the seal should be made of rubber, silicone or a similarly elastic material for example. This hard-soft-hard material combination allows a sealing effect to be achieved, which provides the required feedback suppression. The seal also protects the receiver from cerumen, dirt and sweat.

The seal can be held in the adapter due to its form. This prevents the seal slipping from the adapter, when the receiver is pulled or pushed out of the adapter.

According to one particular embodiment the seal is injected into the adapter using a 2-component injection molding technique. This can reduce manufacturing outlay and logistics outlay in some circumstances.

The receiver connector can also have a conical surface and a shoulder forming the first snap-fit element on the largest circumference of this surface, with which shoulder the second snap-fit element of the adapter engages. This allows a defined position of the receiver connector in the adapter and the required sealing effect to be achieved.

The second snap-fit element can have three snap-fit lugs for example, these being distributed at regular intervals on the circumference of the adapter. These snap-fit lugs can be sprayed easily onto the adapter and ensure an adequate connecting force. They can also be released with a corresponding configuration.

The seal can also have a cylindrical segment, in which a cerumen protector is secured. In particular the cerumen protector can be secured in the cylindrical segment for example in a friction-locked manner. This gives the seal a further functionality, namely that of holding the cerumen protector.

BRIEF DESCRIPTION OF THE DRAWINGS

The present invention is described in more detail below with reference to the accompanying drawings, in which.

DETAILED DESCRIPTION OF INVENTION

The exemplary embodiment described in more detail below represents a preferred embodiment of the present invention.

Figure 1:
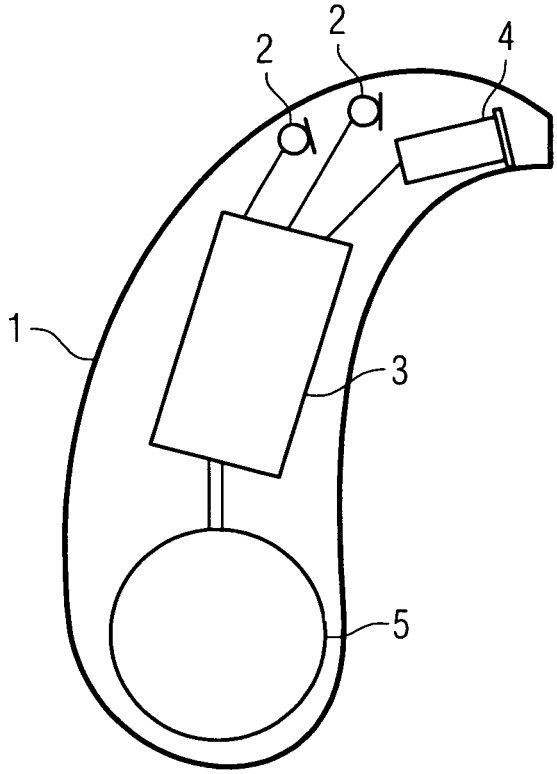
FIG 1 (Prior art)
FIG. 1 shows the basic structure of a hearing aid according to the prior art.
Figure 2:
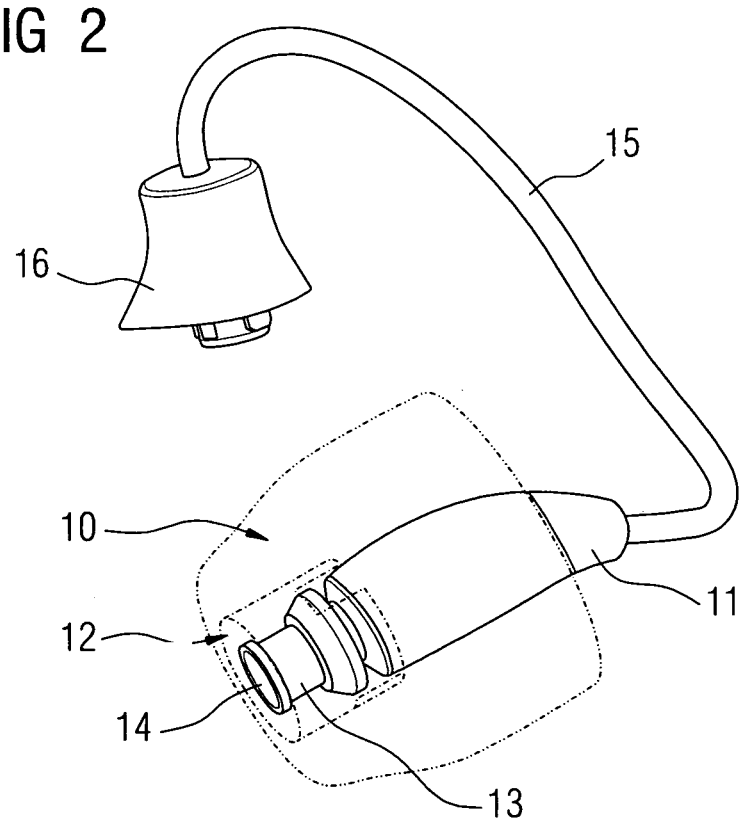
FIG. 2 shows an external receiver unit with ear mold according to the present invention.

FIG. 2 shows an external receiver unit, to be connected to a hearing aid main unit to be worn behind the auricle. The external receiver unit has an ear mold 10, in which an external receiver 11 is secured. The securing means is described in more detail in conjunction with the further FIGS. 3 to 7. Securing is effected with the aid of an ear mold adapter 12 and an acoustic seal 13. The sound from the receiver 11 leaves the ear mold 10 by way of a cerumen protector 14. The receiver 11 is supplied with electrical signals, which it receives from the hearing aid main unit, by way of a signal line 15. To this end the signal line 15 is connected to the hearing aid main unit with the aid of a plug connector 16. The securing of the receiver 11 in the ear mold 10 should satisfy the following requirements for example:

1. "HOLDING": It should be possible to secure the external receiver 11 in the ear mold 10 so that it can be released multiple times.

2. "SEALING": The external receiver 11 should be protected from cerumen, dirt, sweat, etc. It should also be secured in the ear mold 10 in an acoustically sealed manner, so that no sound can penetrate outward.

3. "OSCILLATION DAMPING": The oscillations of the receiver 11 in relation to the ear mold 10 should be damped. This applies even more to high-performance receivers, which execute relatively large movements or natural oscillations.

4. "RECEIVER PROTECTOR HOLDER": The ear mold adapter 12 also advantageously has the functionality of cerumen protector holder at the same time.

Figure 3:
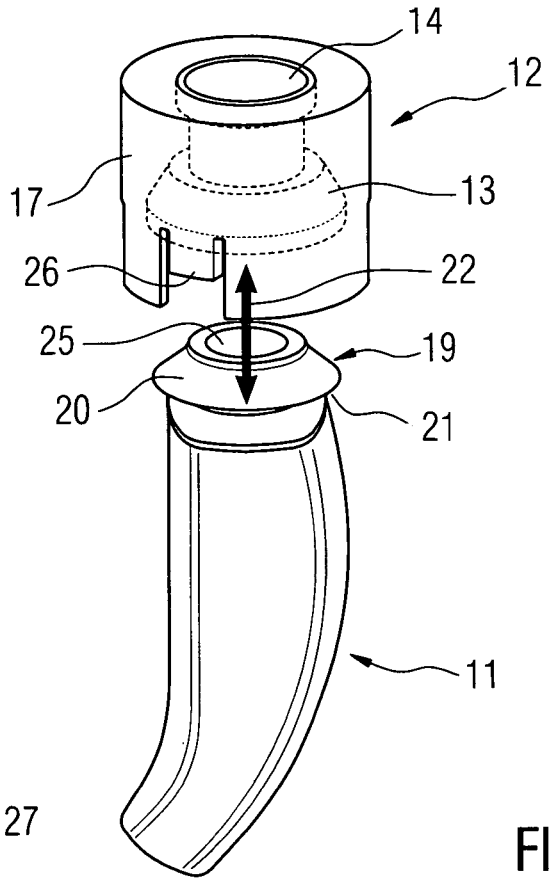
FIG. 3 shows a receiver and an adapter separated from each other.

According to the invention the four requirements set out above are satisfied by a two-part ear mold adapter 12. Such an ear mold adapter 12 is shown in FIG. 3. It consists of a cylindrical adapter shell 17 and a funnel-shaped, soft seal 13. The adapter shell 17 is configured as a hard plastic part and satisfies the requirements for holding and multiple replacement as set out in point 1 above. This part is made of polyamide or a comparable plastic for example.

The soft seal 13, made for example of rubber or silicone, satisfies the sealing, oscillation damping and receiver protector holder requirements as set out in points 2 to 4 above.

In the example selected here the receiver 11 has a conical receiver connector 19. This has a sound outlet 25 at its center, from which the conical surface 20 extends. At the largest circumference of the conical surface 20 the receiver connector 19 has an undercut 21 or shoulder. The receiver 11 is inserted into the ear mold adapter 12 according to the arrow 22.

Figure 4:
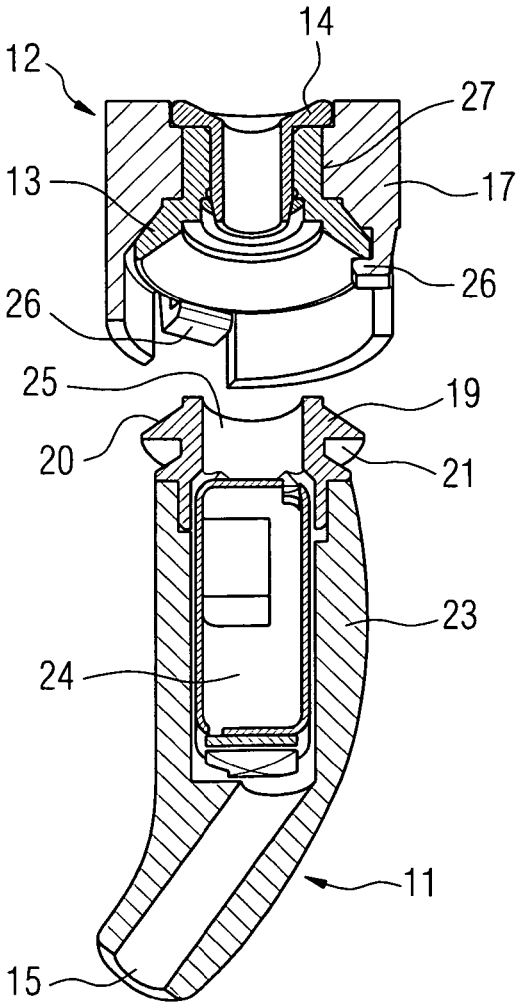
FIG. 4 shows a longitudinal section through the image in FIG. 3.

A longitudinal section of the ear mold adapter 12 and the receiver 11 is shown in FIG. 4. The receiver 11 consists of a receiver housing 23 and a converter 24 located therein.

The converter 24 is connected electrically to the signal line 15. On the output side the converter 24 emits the sound into a tubular sound outlet 25, which is formed by the receiver connector 19. The conical surface 20 and undercut 21 can be seen on the receiver connector 19.

The sectional diagram of the ear mold adapter 12 also shows a casing in the form of the hard adapter shell 17, which also has the snap-fit function. To this end the adapter shell 17 has snap-fit lugs 26. The funnel-shaped seal 13 is located inside the adapter shell 17. It has a conical inner surface, which corresponds to the conical surface 20 of the receiver connector 19.

The adapter shell 17 has a hole 27 on the sound output side, into which hole 27 a tubular segment of the seal 13 is inserted. The cerumen protector 14, which is itself configured as roughly funnel-shaped, is inserted into the tubular segment of the seal 13 from the sound outlet side. Since the seal 13 is made of a rubber-type, soft elastic material and the cerumen protector 14 has a rather larger external diameter than the internal diameter of the tubular segment of the seal 13, the cerumen protector 14 is held in the ear mold adapter 12 by the seal 13 in a friction-locked manner.

Figure 5:
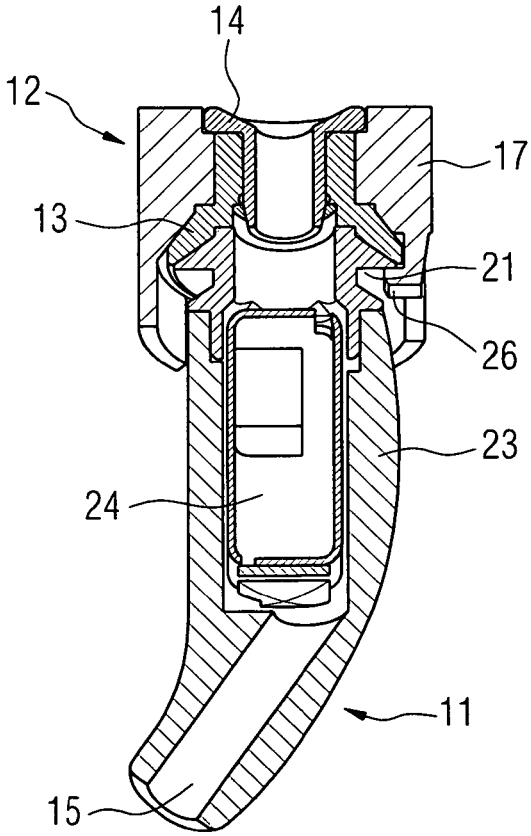
FIG. 5 shows a longitudinal section of the receiver snap-fitted into the adapter.

FIG. 5 shows the ear mold adapter 12 and the receiver 11 in the assembled state. It can be seen that the snap-fit lugs 26 of the adapter shell 17 engage behind the undercut 21 of the receiver connector 19, so that the receiver 11 is held in the ear mold adapter 12. The conical surface 20 hereby presses against the seal 13, so that a sealing effect is ensured both against cerumen, dirt and sweat and also against sound, which could escape outward past the receiver connector 19, if there were no seal.

Figure 6:
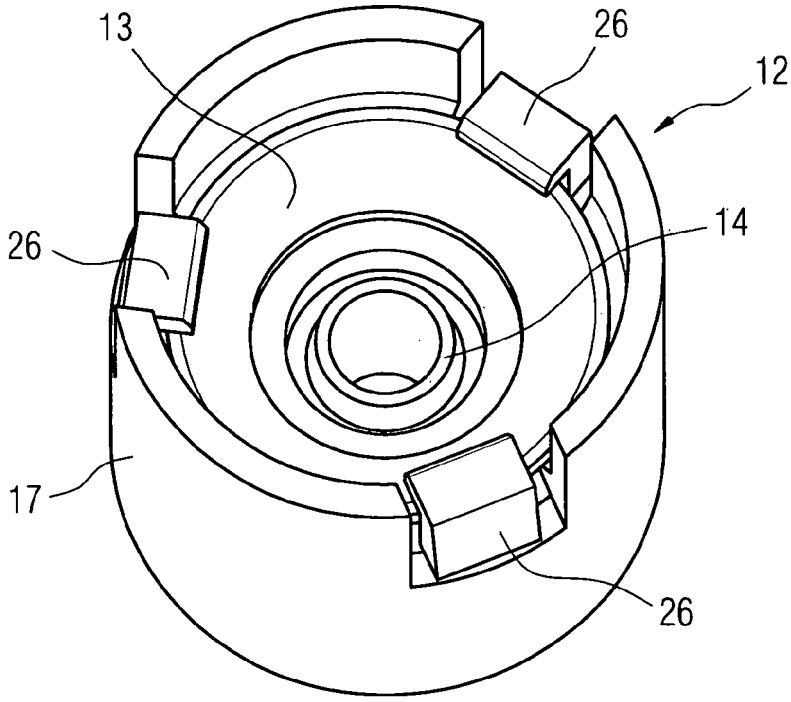
FIG. 6 shows the adapter from FIG. 3 from the side facing the receiver and FIG. 7 shows the adapter from FIG. 6 without the seal and cerumen protector.

FIG. 6 shows the ear mold adapter 12 enlarged and visible from the side facing the receiver 11. It shows the adapter casing 17 with a round opening, into which the snap-fit lugs 26 project. The funnel-shaped seal 13 is inserted into the opening below the snap-fit lugs 26. The cerumen protector 14 is in turn inserted into the tubular segment of the seal 13 from the sound outlet side.

Figure 7:
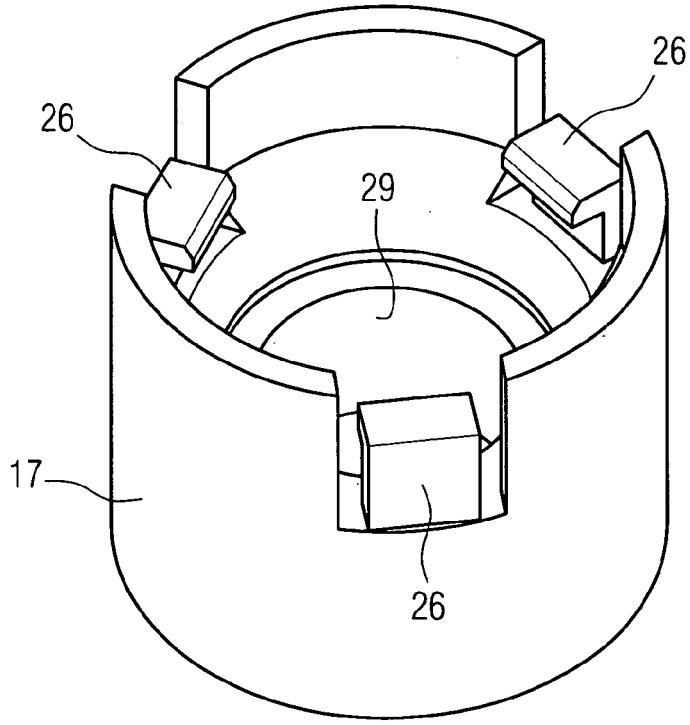

The seal 13, a soft component, can be configured for example as an insert with a form-fit or can be fixed by means of adhesion directly in the hard component, the adapter shell 17. Alternatively the two components 17 and 13 can also be produced by means of 2-component injection molding in one work process. FIG. 7 shows the adapter shell 17 without seal 13 and without cerumen protector 14. The sprayed on snap-fit lugs 26 can again be seen. The larger hole 29 is also visible, into which the seal 13 is inserted. The adapter shell 17 is secured in the ear mold 10 for example by adhesion or by a different connecting technique.

The active ear mold shown above in conjunction with FIGS. 2 to 7 with the receiver adapter and seal according to the present invention offers numerous advantages. The "HOLDING" and "SEALING" functions are transferred specifically to two materials or components with the corresponding characteristics. It is thus possible to adapt the material characteristics to requirements in an optimum manner. Specifically the hard part or hard parts take over the function of mechanical stability and multiple interchangeability. The low level of wear means that the components have an extended service life. The soft part, in this instance the seal 13, seals effectively, acoustically and against dirt. It also holds the receiver protector in an optimum manner due to its form, also providing effective sealing at this interface.

Because the receiver is not snapped directly into the ear mold but is inserted into an opening in the ear mold with the aid of an adapter, it is possible to insert a plurality of receivers of different shapes and sizes into the ear mold.

The seal also has the advantage that external receivers with considerably greater amplification than those without a seal can be deployed. It is thus possible to achieve amplifications in the region of 65 dB with the inventive active ear mold. The seal also has the advantage that it can be replaced in the event of wear (e.g. embrittlement), if it is designed as a so-called "service part". This ensures that the fixing system between the receiver and ear mold is also sealed adequately in the long term.

The invention claimed is:

1. A receiver unit for a hearing device, comprising:

an ear mold;

a receiver having a receiver connector including a first snap-fit element at a sound outlet;

an adapter inserted directly into the ear mold and which has a second snap-fit element, which is snapped into the first snap-fit element in a manner such that it can be released; and a seal that surrounds the receiver connector completely and is made of a more elastic material than the receiver connector and the adapter and is fitted between the receiver connector and the adapter.

2. The receiver unit as claimed in claim 1, wherein the adapter is made of polyamide.

3. The receiver unit as claimed in claim 1, wherein the seal is made of rubber silicone.

4. The receiver unit as claimed in claim 1, wherein the seal is held in the adapter due to its form.

5. The receiver unit as claimed in claim 1, wherein the seal is injected into the adapter using a 2-component injection molding technique.

6. The receiver unit as claimed in claim 1, wherein the receiver connector has a conical surface and a shoulder forms the first snap-fit element on the largest circumference of the conical surface, with which shoulder the second snap-fit element of.

7. The receiver unit as claimed in claim 1, wherein the second snap-fit element has three snap-fit lugs, which are distributed at regular intervals on the circumference of the adapter.

8. The receiver unit as claimed in claim 1, wherein the seal has a cylindrical segment, in which a cerumen protector is secured.

9. The receiver unit as claimed in claim 8, wherein the cerumen protector is secured in the cylindrical segment in a friction-locked manner.

10. The receiver unit as claimed in claim 1, wherein the adapter is made of hard plastic.

11. The receiver unit as claimed in claim 7, wherein the adapter is made of polyamide.

12. The receiver unit as claimed in claim 7, wherein the seal is made of an elastic material.

13. The receiver unit as claimed in claim 12, wherein the seal is made of rubber silicone.

14. The receiver unit as claimed in claim 12, wherein the seal is held in the adapter due to its form.

15. The receiver unit as claimed in claim 14, wherein the seal is injected into the adapter using a 2-component injection molding technique.

16. The receiver unit as claimed in claim 15, wherein the receiver connector has a conical surface and a shoulder forms the first snap-fit element on the largest circumference of the conical surface, with which shoulder the second snap-fit element of.

17. The receiver unit as claimed in claim 16, wherein the second snap-fit element has three snap-fit lugs, which are distributed at regular intervals on the circumference of the adapter.

18. The receiver unit as claimed in claim 17, wherein the seal has a cylindrical segment, in which a cerumen protector is secured.

19. The receiver unit as claimed in claim 17, wherein the cerumen protector is secured in the cylindrical segment in a friction-locked manner.

20. A receiver unit for a hearing device, comprising:

a receiver having a conical receiver connector at a sound outlet, said conical receiver connector including a conical surface and a shoulder at a largest circumference of the conical surface;

an adapter inserted directly into the ear mold, said adapter having a cylindrical adapter shell configured as a hard plastic part and made of polyamide, said cylindrical adapter shell including snap-fit lugs such that when the receiver is positioned within the ear mold, said snap-fit lugs are snapped over the shoulder such they can be released; and a funnel-shaped seal made of rubber or silicone, said funnel-shaped seal configured to surround the receiver connector completely and is made of a more elastic material than the receiver connector, and the funnel-shaped seal is fitted between the receiver connector and the adapter wherein the funnel-shaped seal has a conical inner surface which corresponds to the conical surface of the conical receiver connector.

* * * * *